US011535029B2

(12) United States Patent
Serra Vall et al.

(10) Patent No.: US 11,535,029 B2
(45) Date of Patent: Dec. 27, 2022

(54) PRINTING MODES TO PRINT AN OUTLINE AND A FILL AREA

(71) Applicant: HEWLETT-PACKARD DEVELOPMENT COMPANY, L.P., Spring, TX (US)

(72) Inventors: Marc Serra Vall, Sant Cugat del Valles (ES); M. Isabel Borrell Bayona, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 162 days.

(21) Appl. No.: 16/977,912

(22) PCT Filed: Apr. 25, 2018

(86) PCT No.: PCT/US2018/029294

§ 371 (c)(1),
(2) Date: Sep. 3, 2020

(87) PCT Pub. No.: WO2019/209281

PCT Pub. Date: Oct. 31, 2019

(65) Prior Publication Data

US 2021/0008877 A1 Jan. 14, 2021

(51) Int. Cl.

| | |
|---|---|
| ***B41J 2/045*** | (2006.01) |
| ***B41J 2/155*** | (2006.01) |
| ***B41J 2/21*** | (2006.01) |

(52) U.S. Cl.

CPC ..... *B41J 2/04551* (2013.01); *B41J 2/04518* (2013.01); *B41J 2/04586* (2013.01); *B41J 2/155* (2013.01); *B41J 2/2146* (2013.01); *B41J 2202/21* (2013.01)

(58) Field of Classification Search

CPC ..... B41J 2202/21; B41J 2/2146; B41J 2/155; B41J 2/04586; B41J 2/04518; B41J 2/04551

See application file for complete search history.

(56) References Cited

U.S. PATENT DOCUMENTS

| | | | |
|---|---|---|---|
| 6,183,062 | B1 | 2/2001 | Curtis et al. |
| 7,338,144 | B2 | 3/2008 | Mantell |
| 8,605,303 | B2 | 12/2013 | Wu et al. |
| 8,851,594 | B2 | 10/2014 | Puigardeu et al. |

(Continued)

FOREIGN PATENT DOCUMENTS

| | | |
|---|---|---|
| CN | 101515986 | 8/2009 |
| CN | 104044271 | 9/2014 |

(Continued)

*Primary Examiner* — Jannelle M Lebron

(57) ABSTRACT

An example of a printing system is disclosed. The example disclosed herein comprises a plurality of nozzles and a controller. The plurality of nozzles is to eject a printing agent on a substrate to print a print job. The controller is to receive the print job comprising an outline and a fill area to be printed. The controller is also to define a first subset of the plurality of nozzles as a first printing mode to print the outline. The controller is further to define a second subset of the plurality of nozzles as a second printing mode to print the fill area, wherein the second subset comprises more nozzles than the first subset. The controller is further to print the print job based on the first printing mode and the second printing mode.

20 Claims, 7 Drawing Sheets

(56) References Cited

U.S. PATENT DOCUMENTS

| | | | |
|---|---|---|---|
| 9,134,233 | B2 | 9/2015 | Taff et al. |
| 9,211,699 | B2 | 12/2015 | Rossell et al. |
| 9,460,491 | B2 | 10/2016 | Bai et al. |
| 2003/0222939 | A1 | 12/2003 | Gompertz |
| 2006/0139396 | A1 | 6/2006 | Baker |
| 2007/0057993 | A1 | 3/2007 | Youn |
| 2010/0066779 | A1 | 3/2010 | Gothait |
| 2012/0268539 | A1 | 10/2012 | Kondo |
| 2018/0022122 | A1 | 1/2018 | Sanjuan et al. |

FOREIGN PATENT DOCUMENTS

| | | |
|---|---|---|
| CN | 105103529 | 11/2015 |
| JP | 2000177151 | 6/2000 |
| JP | 2004306392 | 11/2004 |

PRINTING MODES TO PRINT AN OUTLINE AND A FILL AREA

BACKGROUND

Some printing systems comprise carriages with printheads to eject ink on a substrate. Said printing systems may be to print a print job following on a plurality of printing instructions. The print job may correspond to plain text to be printed, other print jobs may be, e.g., two-dimensional objects to be printed, and yet other print jobs may be a combination thereof.

To increase the speed of the printing operations, the carriage of some printing systems may span the full width of the substrate at a higher hardware cost. To reduce the cost of the printing systems, some printing systems comprise a carriage that spans a part of the width of the substrate and is to scan through the full width of the substrate.

BRIEF DESCRIPTION OF THE DRAWINGS

The present application may be more fully appreciated in connection with the following detailed description taken in conjunction with the accompanying drawings, in which like reference characters refer to like parts throughout and in which.

DETAILED DESCRIPTION

Figure 1:
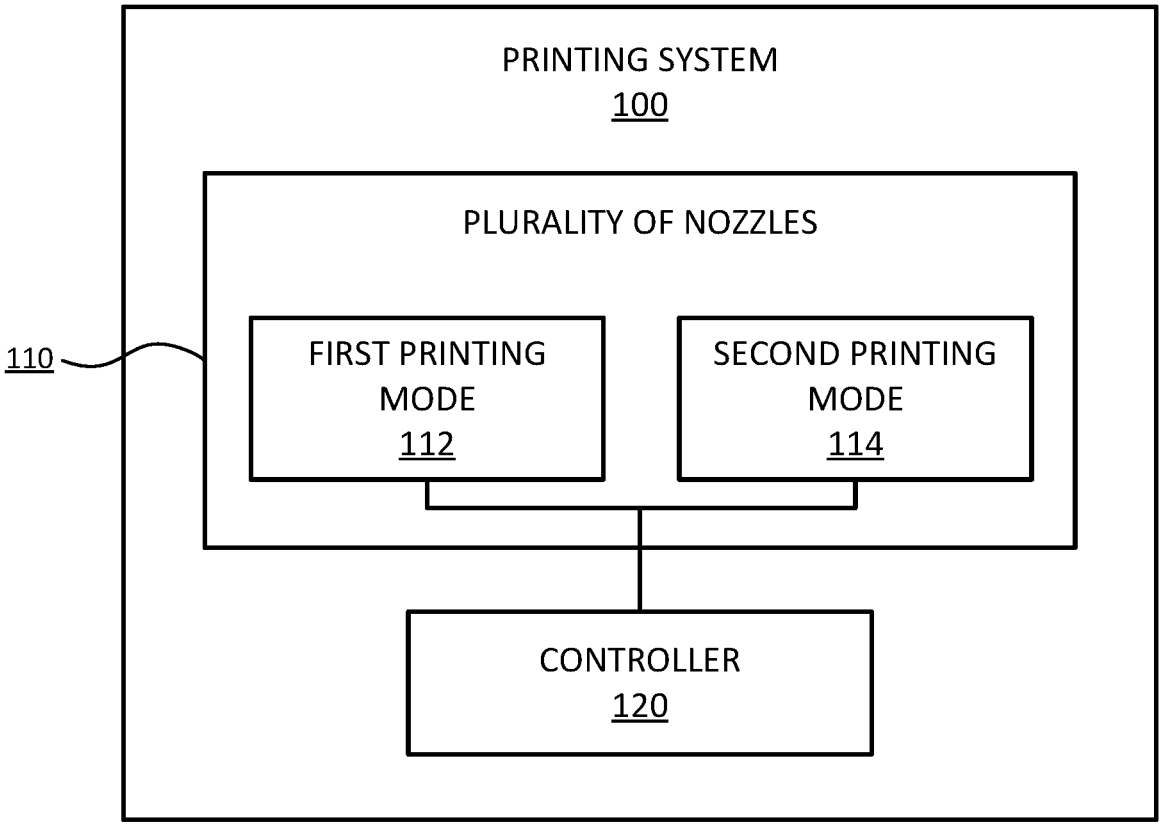
FIG. 1 is a block diagram illustrating an example of a printing system with printing modes to print an outline and a fill area.

The following description is directed to various examples of the disclosure. In the foregoing description, numerous details are set forth to provide an understanding of the examples disclosed herein. However, it will be understood by those skilled in the art that the examples may be practiced without these details. While a limited number of examples have been disclosed, those skilled in the art will appreciate numerous modifications and variations therefrom. It is intended that the appended claims cover such modifications and variations as fall within the scope of the examples. Throughout the present disclosure, the terms "a" and "an" are intended to denote at least one of a particular element. In addition, as used herein, the term "includes" means includes but not limited to, the term "including" means including but not limited to. The term "based on" means based at least in part on.

Some printing systems comprise carriages with printheads to eject ink on a substrate. Said printing systems may be to print a plurality of printing instructions. Some printing instructions may be plain text to be printed, other printing instructions may be two-dimensional objects to be printed, and yet other printing instructions may be a combination thereof.

To increase the speed of the printing operations, the carriage of some printing systems may span the full width of the substrate at a higher hardware cost. To reduce the cost of the printing systems, some printing systems comprise a carriage that spans a part of the width of the substrate and is to scan through the full width of the substrate.

An example of the present disclosure provides a printing system comprising a plurality of nozzles to eject a printing agent on a substrate to print a print job. The printing system may also comprise a controller to perform a plurality of operations. The controller is to receive the print job comprising an outline and a fill area to be printed. The controller is also to define a first subset of the plurality of nozzles as a first printing mode to print the outline. The controller is further to define a second subset of the plurality of nozzles as a second printing mode to print the fill area, wherein the second subset comprises more nozzles than the first subset. The controller is further to print the print job based on the first printing mode and the second printing mode.

Another example of the present disclosure provides a method comprising a plurality of operations to be performed. The method comprises receiving a print job comprising an outline and a fill area to be printed. The method also comprises defining a first subset of a plurality of nozzles as a first printing mode to print the outline. The method further comprises defining a second subset of the plurality of nozzles as a second printing mode to print the fill area, wherein the second subset comprises more nozzles than the first subset. The method further comprises printing, by the plurality of nozzles, the print job based on the first printing mode and the second printing mode.

Another example of the preset disclosure provides a non-transitory machine-readable medium storing instructions executable by a processor. The non-transitory machine-readable medium comprises instructions to receive a print job comprising an outline and a fill area to be printed. The non-transitory machine readable medium also comprises instructions to define a first subset of a plurality of nozzles as a first printing mode to print the outline. The non-transitory machine readable medium further comprises instructions to define a second subset of the plurality of nozzles as a second printing mode to print the fill area, wherein the second subset comprises more nozzles than the first subset. The non-transitory machine readable medium further comprises instructions to print the print job based on the first printing mode and the second printing mode by ejecting printing agent using the plurality of nozzles.

FIG. 1 is a block diagram illustrating an example of a printing system 100 with printing modes to print an outline and a fill area, i.e., a first printing mode to print the outline and a second printing mode to print the fill area. The printing system 100 comprises a plurality of nozzles 110. The plurality of nozzles 100 may be placed in an array, print bar, plurality of print bars, print carriage, printheads, and/or the like. Some examples of the plurality of nozzles 110 are shown in FIGS. 2-6. The plurality of nozzles is to eject a printing agent on a substrate to print a print job. In the present disclosure, the term "nozzle" should be understood as any cylindrical or round spout at the end of a pipe hose, or tube used to control a jet of the printing agent. The printing agent may be any composition used in printing operations. In an example, the printing agent composition comprises pigments, colorants and/or inks. A wide variety of substrates to be printed onto may be used. In an example, a paper substrate may be used. Other examples may use different types of substrates, such as a fabric substrate, a polymeric substrate, and/or an additive manufacturing build material. These are examples of substrates; however other substrates may be used without departing from the scope of the present disclosure. The printing system 100 may also comprise a controller 120 connected to the plurality of nozzles 110. The controller connection may be by means of a physical wire and/or wireless. The term "controller" as used herein may include a series of instructions encoded on a machine-readable storage medium and executable by a single processor or a plurality of processors. Additionally, or alternatively, a controller may include at least one hardware devices including electronic circuitry, for example a digital and/or analog application-specific integrated circuit (ASIC), for implementing the functionality described herein.

The controller 120 is to receive the print job comprising an outline and a fill area to be printed. The print job may be any set of instructions to print a two-dimensional (2D) object comprising an outline and a fill area. The outline should be understood as a line, or a set of lines enclosing the shape of the 2D object. The fill area should be understood as the area to be printed enclosed within the outline. In an example, the print job may be sent to the controller 120 by a user through a user interface (e.g., personal computer, tablet, smartphone, and/or the like).

The controller 120 is further to define a first subset of the plurality of nozzles 110 as a first printing mode 112 to print the outline. The controller 120 is further to define a second subset of the plurality of nozzles 110 as a second printing mode 114 to print the fill area, wherein the second subset may comprise more nozzles than the first subset or comprise nozzles that eject drops with a higher drop size than the nozzles corresponding to the first subset. If the print job comprises a plurality of 2D objects to be printed, the first printing mode 112 may comprise a plurality of outlines to be printed, and the second printing mode 114 may comprise a plurality of fill areas to be printed. In an example, the second subset of nozzles does not comprise any of the nozzles from the first subset of the plurality of nozzles 110. In another example, the second subset of nozzles may comprise the nozzles from the first subset of the plurality of nozzles. In yet another example, the second subset of nozzles may comprise a part of the nozzles from the first subset of the plurality of nozzles.

The controller 120 is further to print the print job based on the first printing mode 112 and the second printing mode 114. The outline or the plurality of outlines of the printing job may be printed by the first printing mode 112, i.e., using a first subset of the plurality of nozzles. The fill area or the plurality of fill areas of the printing job may be printed by the second printing mode 114, i.e., using a second subset of the plurality of nozzles 110. In an example, a nozzle from the plurality of nozzles 110 may not print neither the outline or plurality of outlines, nor the fill area or plurality or fill areas. In another example, a nozzle from the plurality of nozzles 110 may print part of the outline and/or plurality of outlines, but may not print the fill area nor the plurality of fill areas. In another example, a nozzle from the plurality of nozzles 110 may print part of the fill area and/or plurality of fill areas, but may not print the outline nor the plurality of outlines. In yet another example, a nozzle from the plurality of nozzles 110 may print both part of the outline or plurality of outlines, and part of the fill area or plurality or fill areas.

Figure 2:
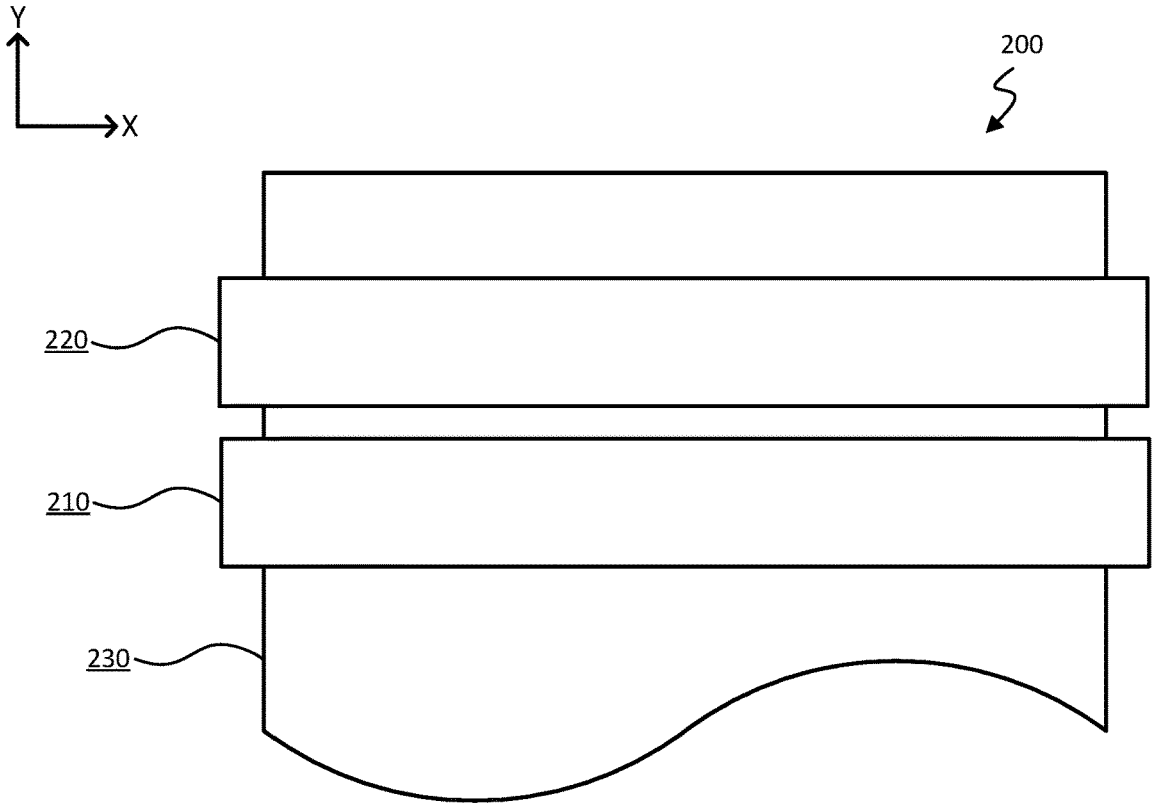
FIG. 2 is a block diagram illustrating another example of a printing system with printing modes to print an outline and a fill area.

FIG. 2 is a block diagram illustrating another example of a printing system 200 with printing modes to print an outline and a fill area. The printing system 200 may be a configuration of the plurality of nozzles 110 from FIG. 1. The printing system 200 may be a page-wide array printing system comprising a first print bar 210 and a second print bar 220. The first print bar 210 and the second print bar 220 may be substantially parallel bars. The length of the first print bar 210 and the length of the second print bar 220 define a print bar axis (shown as X axis). The first subset of the plurality of nozzles (e.g., plurality of nozzles 110 from FIG. 1) defined as the first printing mode (e.g., first printing mode 112 from FIG. 1), may be a set of nozzles comprised in the first print bar 210. The second subset of the plurality of nozzles (e.g., plurality of nozzles 110 from FIG. 1) defined as the second printing mode (e.g., second printing mode 114 from FIG. 1), may be a set of nozzles comprised in both the first print bar 210 and the second print bar 220. In an example, a nozzle from the first print bar 210 may be defined as part of the first printing mode and part of the second printing mode. In another example, a nozzle from the first print bar 210 may be defined as part of the first printing mode and may not be defined as part of the second printing mode. In yet another example, a nozzle from the first print bar 210 may be defined as part of the second printing mode and may not be defined as part of the first printing mode. In a further example, the nozzles within the first bar 210 may be used for printing in the first printing mode 112 and the nozzles within the first bar 210 and the second print bar 220 may be used for printing in the second printing mode 114.

As used herein, the term "substantially" is used to provide flexibility to a numerical range endpoint by providing that a given value may be, for example, an additional 15% more or an additional 15% less than the endpoints of the range. Furthermore, the term "substantially" may provide flexibility in the relative position between a plurality of objects. As an example, some substantially parallel bars may have up to 20 degrees of difference between their respective axis. As another example, some substantially perpendicular objects may have from 70 to 110 degrees of difference between their respective axis. The degree of flexibility of this term can be dictated by the particular variable and would be within the knowledge of those skilled in the art to determine based on experience and the associated description herein.

The printing system 200 may also comprise a substrate 230. Substrate 230 may be a paper substrate, fabric substrate, polymeric substrate, and/or the like. The substrate may advance in a substantially perpendicular direction from the X axis (shown as Y axis). The substrate advancement direction is the direction of the length of the substrate 230. In the example, the first printing bar 210 and the second printing bar 220 span substantially the full width of the substrate 230.

The outline or the plurality of outlines of the printing job may be printed on the substrate 230 by the nozzles defined as nozzles for the first printing mode located in the first printing bar 210. The fill area or the plurality of fill areas of the printing job may be printed on the substrate 230 by the nozzles defined as nozzles for the second printing mode from both the first print bar 210 and the second print bar 220, in an example, the nozzles for the second printing mode may include the nozzles from the first printing mode in addition to a set of nozzles from the second print bar 220. Some examples may comprise additional print bars (e.g., third print bar, fourth print bar, fifth print bar, and the like) substantially parallel to the second printing bar. The additional print bars may be to eject the printing agent to the substrate 230 based on the print job. The controller (e.g., controller 110 from FIG. 1) may define the additional nozzles from the additional printing bars as part of the second printing mode. Therefore, the additional nozzles from the additional printing bars being to print part of the fill area or the plurality of fill areas of the printing job on the substrate 230.

Figure 3:
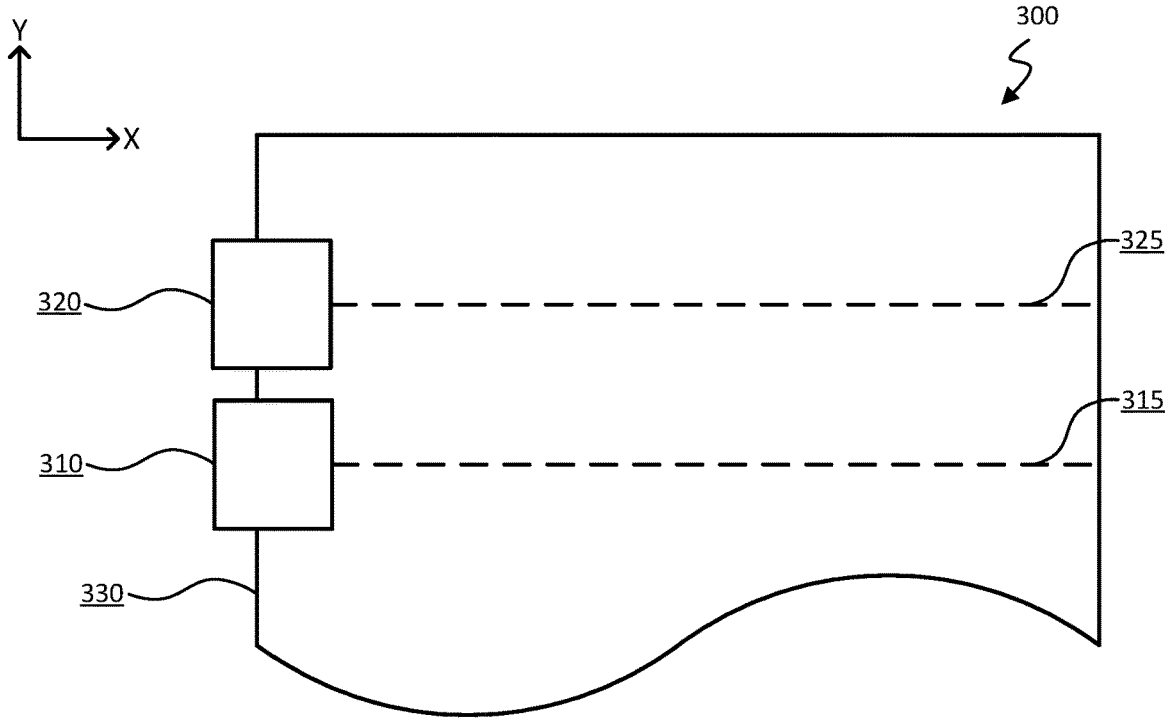
FIG. 3 is a block diagram illustrating another example of a printing system with printing modes to print an outline and a fill area.

FIG. 3 is a block diagram illustrating another example of a printing system 300 with printing modes to print an outline and a fill area. The printing system 300 may be a configuration of the plurality of nozzles 110 from FIG. 1. The printing system 300 may comprise a first print bar 310 and a second print bar 320. The first print bar 310 and the second print bar 320 may be substantially parallel bars. The length of the first print bar 310 and the length of the second print bar 320 define a print bar axis (shown as X axis). The first subset of the plurality of nozzles (e.g., plurality of nozzles 110 from FIG. 1) defined as the first printing mode (e.g., first printing mode 112 from FIG. 1), may be a set of nozzles comprised in the first print bar 310. The second subset of the plurality of nozzles (e.g., plurality of nozzles 110 from FIG. 1) defined as the second printing mode (e.g., second printing mode 114 from FIG. 1), may be a set of nozzles comprised in both the first print bar 310 and the second print bar 320. In an example, a nozzle from the first print bar 310 may be defined as part of the first printing mode and part of the second printing mode. In another example, a nozzle from the first print bar 310 may be defined as part of the first printing mode and may not be defined as part of the second printing mode. In yet another example, a nozzle from the first print bar 310 may be defined as part of the second printing mode and may not be defined as part of the first printing mode.

The printing system 300 may also comprise a substrate 330. Substrate 330 may be a paper substrate, a fabric substrate, a polymeric substrate, and/or the like. The substrate may advance in a substantially perpendicular direction from the X axis (shown as Y axis). The substrate advancement direction is the direction of the length of the substrate 330. In the example, the first printing bar 310 and the second printing bar 320 span a section of the width of the substrate 330. The printing system 300 may comprise a first scanning mechanism 315 coupled to the first print bar 310; and a second scanning mechanism 325 coupled to the second print bar 320. The first scanning mechanism 315 and the second scanning mechanism 325 may be any mechanism to move the first print bar 310 and the second print bar 320 respectively across substantially a full width of the substrate 330. As an example, the first scanning mechanism 315 and the second scanning mechanism 325 may comprise a guide and a scanning engine to move the first print bar 310 and the second print bar 320 along the width of the substrate 330. This is an example, and any other scanning mechanism may be used without departing from the scope of the present disclosure.

The outline or the plurality of outlines of the printing job may be printed on the substrate 330 by the nozzles defined as the first printing mode located in the first printing bar 310. The fill area or the plurality of fill areas of the printing job may be printed on the substrate 330 by the nozzles defined as the second printing mode from both the first print bar 310 and the second print bar 320. Some examples may comprise additional print bars (e.g., third print bar, fourth print bar, fifth print bar, and the like) substantially parallel to the second printing bar. The additional print bars may be to eject the printing agent to the substrate 330 to perform the printing operation. The controller (e.g., controller 110 from FIG. 1) may define the additional nozzles from the additional printing bars as part of the second printing mode. Therefore, the additional nozzles from the additional printing bars being to print part of the fill area or the plurality of fill areas of the printing job on the substrate 330.

Figure 4:
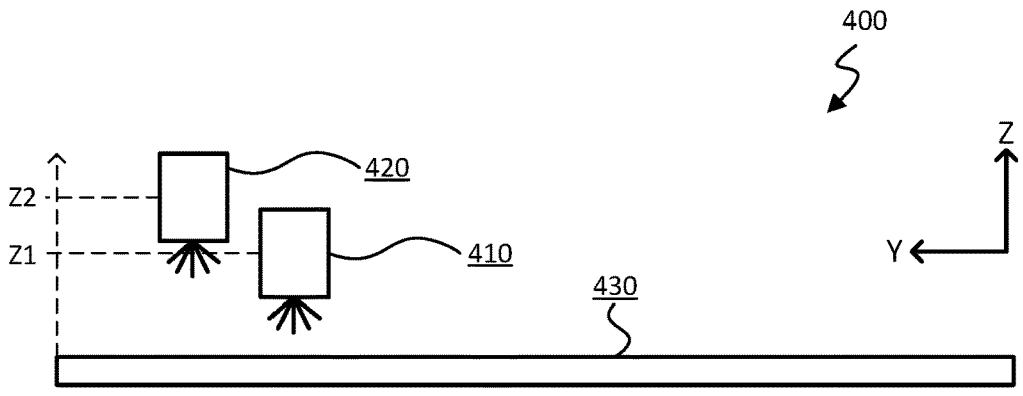
FIG. 4 is a block diagram illustrating another example of a printing system with printing modes to print an outline and a fill area.

FIG. 4 is a block diagram illustrating another example of a printing system 400 with printing modes to print an outline and a fill area. The printing system 400 may be an implementation of the printing system 200 from FIG. 2; and/or an implementation of the printing system 300 from FIG. 3. The printing system 400 may comprise a first print bar 410 and a second print bar 420. The first print bar 410 may be the same as or similar to the first print bar 210 from FIG. 2, or the first print bar 310 from FIG. 3. The second print bar 420 may be the same as or similar to the second print bar 220 from FIG. 2, or the second print bar 320 from FIG. 3. The printing system 400 further comprises a substrate 430. The substrate 430 may be the same as or similar to the substrate 230 from FIG. 2 and/or the substrate 330 from FIG. 3. The first print bar 410 and the second print bar 420 may comprise a plurality of nozzles (e.g., plurality of nozzles 110 from FIG. 1) to eject a printing agent on the substrate 430 to print a print job.

A controller (e.g., controller 120 from FIG. 1) may define a first printing mode (e.g., first printing mode 112 from FIG. 1) to print the outline of a printing job, and a second printing mode (e.g., second printing mode 114 from FIG. 1) to print the fill area of said printing job. The first printing mode may be printed using the first printing bar 410, and the second printing mode may be printed using the first printing bar 410 and the second printing bar 420.

In an example, the first printing bar 410 may be installed at a lower height (e.g., see height point Z1) than the second printing bar 420 that may be installed at a higher height (e.g., see height point Z2 higher than height point Z1 in the Z axis). Therefore, the first printing bar 410 may be closer to the substrate 430 than the second print bar 420. A further example may comprise installing additional printing bars, the additional printing bars being installed substantially at the same height as the second print bar 420 (e.g., height point Z2). By installing the first print bar 410 closer to the substrate 430, the outline printing operation output may be printed at a higher definition. By installing the second print bar 420 further to the substrate 430, the user manipulation operations may be easier and the printing system interruptions due to cockle of the substrate 430 may be reduced. In the present disclosure, the term "cockle" should be understood as the undesired wrinkle or creased surface towards the Z axis of the substrate 430 due to, for example, the ejecting printing agent operations and/or a humid working environment.

The substrate 430 advances upstream through the Y axis. In an example, the first print bar 410 is installed upstream in the substrate 430 advance direction with respect to the second print bar 420. In said configuration, the first print bar 410 ejects printing agent to the substrate before the second print bar 420. A further example may comprise additional printing bars, the additional printing bars may be installed downstream in the substrate 430 advance direction with respect to the second print bar 420.

Figure 5:
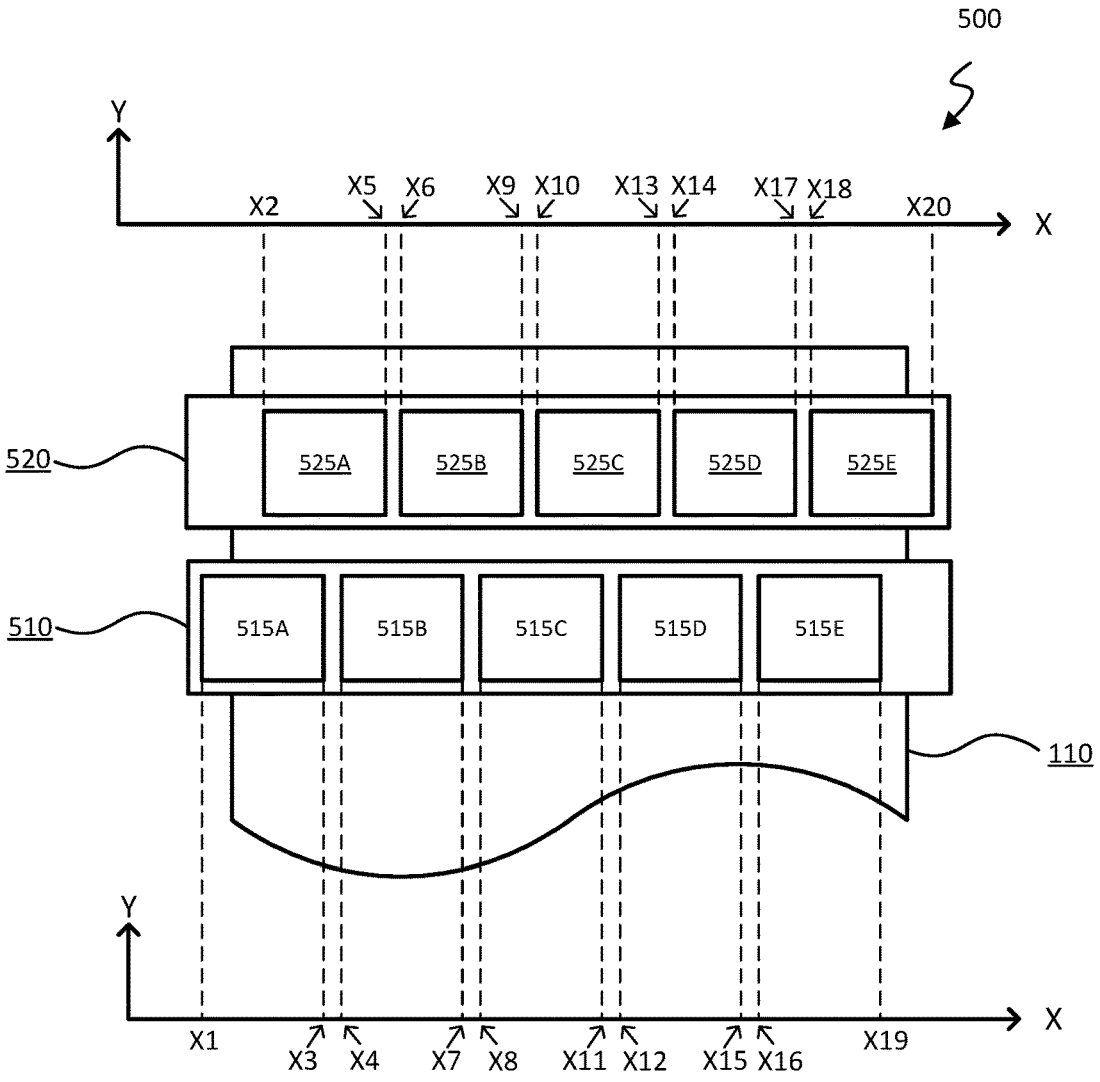
FIG. 5 is a block diagram illustrating another example of a printing system with printing modes to print an outline and a fill area.

FIG. 5 is a block diagram illustrating another example of a printing system 500 with printing modes to print an outline and a fill area. The printing system 500 may be an implementation of the printing system 200 from FIG. 2; and/or an implementation of the printing system 300 from FIG. 3. The printing system 500 comprises a first print bar 520 and a second print bar 520. The first print bar 510 may be the same as or similar to the first print bar 210 from FIG. 2, or the first print bar 310 from FIG. 3. The second print bar 520 may be the same as or similar to the second print bar 220 from FIG. 2, or the second print bar 320 from FIG. 3. The printing system 500 further comprises a substrate 530. The substrate 530 may be the same as or similar to the substrate 230 from FIG. 2 and/or the substrate 330 from FIG. 3. The first print bar 510 and the second print bar 520 may comprise a plurality of nozzles (e.g., plurality of nozzles 110 from FIG. 1) to eject a printing agent on the substrate 430 to print a print job. The plurality of nozzles may be grouped in a plurality of printheads (see, e.g., printhead 600 from FIG. 6). The first printing bar 510 may comprise a first printhead group comprising a plurality of printheads, for example, five printheads: a first printhead 515A, a second printhead 515B, a third printhead 515C, a fourth printhead 515D, and a fifth printhead 515E. This is an example, and a different amount of printheads may be installed in the first printing bar 510. The second printing bar 520 may comprise a second printhead group comprising another plurality of printheads, for example, five printheads: a first printhead 525A, a second printhead 525B, a third printhead 525C, a fourth printhead 525D, and a fifth printhead 525E. This is an example, and a different amount of printheads may be installed in the second printing bar 520. In another example, the first print bar 510 and the second print bar 520 may comprise eight printheads each. In yet another example, the first print bar 510 and the second print bar 520 may comprise a different amount of printheads.

The plurality of printheads 515A-515E in the first printhead group and the plurality of printheads 525A-525E in the second printhead group span a different area in a longitudinal print bar axis (shown as axis X). In the example, the first printhead 515A from the first print bar 510 spans the area comprised between points X1 and X3 from the X axis, and the first printhead 525A from the second print bar 520 spans the area comprised between points X2 and X5 from the X axis; the second printhead 515B from the first print bar 510 spans the area comprised between points X4 and X7 from the X axis, and the second printhead 525B from the second print bar 520 spans the area comprised between points X6 and X9 from the X axis; the third printhead 515C from the first print bar 510 spans the area comprised between points X8 and X11 from the X axis, and the third printhead 525C from the second print bar 520 spans the area comprised between points X10 and X13 from the X axis; the fourth printhead 515D from the first print bar 510 spans the area comprised between points X12 and X15 from the X axis, and the fourth printhead 525D from the second print bar 520 spans the area comprised between points X14 and X17 from the X axis; the fifth printhead 515E from the first print bar 510 spans the area comprised between points X16 and X19 from the X axis, and the fifth printhead 525E from the second print bar 520 spans the area comprised between points X18 and X20 from the X axis. In a further example, points X3 and X4, X5 and X6, X7 and X8, X9 and X10, X11 and X12, X13 and X14, X15 and X16, and X17 and X18 may be substantially the same points. In another further example, points X3 and X4, X5 and X6, X7 and X8, X9 and X10, X11 and X12, X13 and X14, X15 and X16, and X17 and X18 may have an interim gap. Installing the printheads in the previous configuration may average the printed output, therefore increasing the image quality of the filled area printed.

Figure 6:
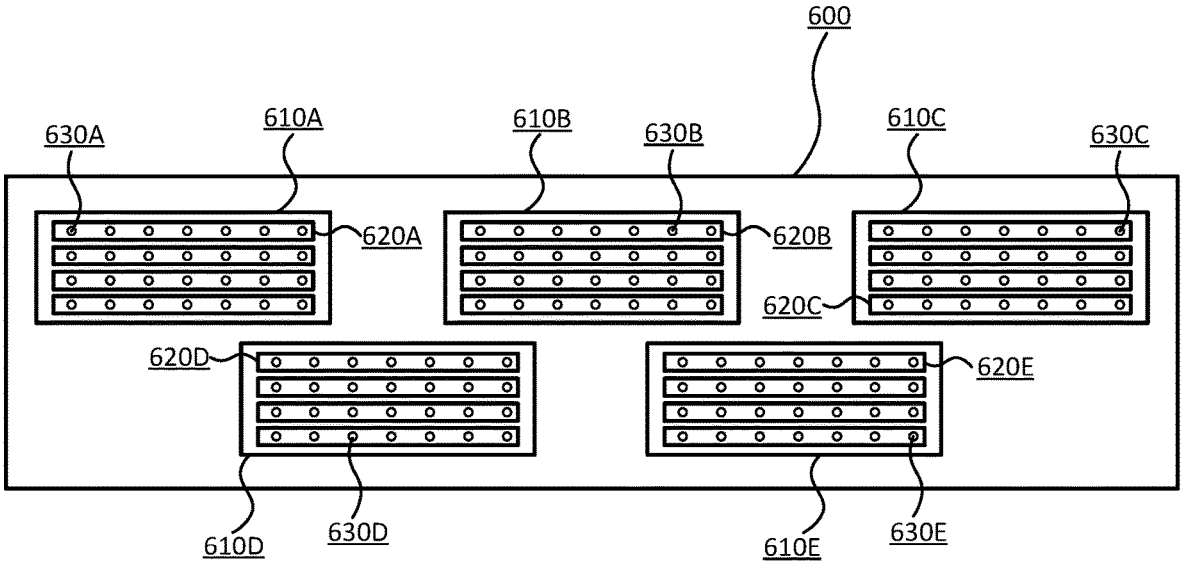
FIG. 6 is a block diagram illustrating an example of a printhead.

FIG. 6 is a block diagram illustrating an example of a printhead 600. Printhead 600 may be any of the printheads 515A-515E and/or 525A-525E from FIG. 5. Printhead 600 may comprise a plurality of dyes, for example, five dyes: a first dye 610A, a second dye 610B, a third dye 610C, a fourth dye 610D, and a fifth dye 610E. This is an example, and a different amount of dyes may be present in the printhead 600 without departing from the scope of the present disclosure. Each dye from the plurality of dyes 610A-610E may comprise a plurality of trenches. In the example, each dye 610A-610E comprises four trenches 620A-620E respectively. However, each dye may comprise a different number of trenches than the example. Each trench in the printhead comprises a plurality of nozzles. In the example, each trench 620A-620E comprises a plurality of nozzles 630A-630E respectively. In an example, each nozzle associated with a trench is to eject the same printing agent. Some example of printing agents may be a printing agent comprising Cyan colorant (e.g., Cyan ink), a printing agent comprising Magenta colorant (e.g., Magenta ink), a printing agent comprising Black colorant (e.g., Black ink), a printing agent comprising White colorant (e.g., White ink), and/or the like. In a further example, a dye in the printhead 600 may comprise four trenches, the nozzles from a first trench to eject Cyan ink, the nozzles from a second trench to eject Magenta ink, the nozzles from a third trench to eject Yellow ink, and the nozzles from a fourth trench to eject black ink.

In an example of the present disclosure, at least two nozzles from different trenches may be to eject a printing agent comprising Cyan colorant in each substrate area unit within the longitudinal print bar axis. In another example of the present disclosure, at least two nozzles from different trenches may be to eject a printing agent comprising Magenta colorant in each substrate area unit within the longitudinal print bar axis. In another example of the present disclosure, at least two nozzles from different trenches may be to eject a printing agent comprising Yellow colorant in each substrate area unit within the longitudinal print bar axis. In another example of the present disclosure, at least two nozzles from different trenches may be to eject a printing agent comprising Black colorant in each substrate area unit within the longitudinal print bar axis.

Figure 7:
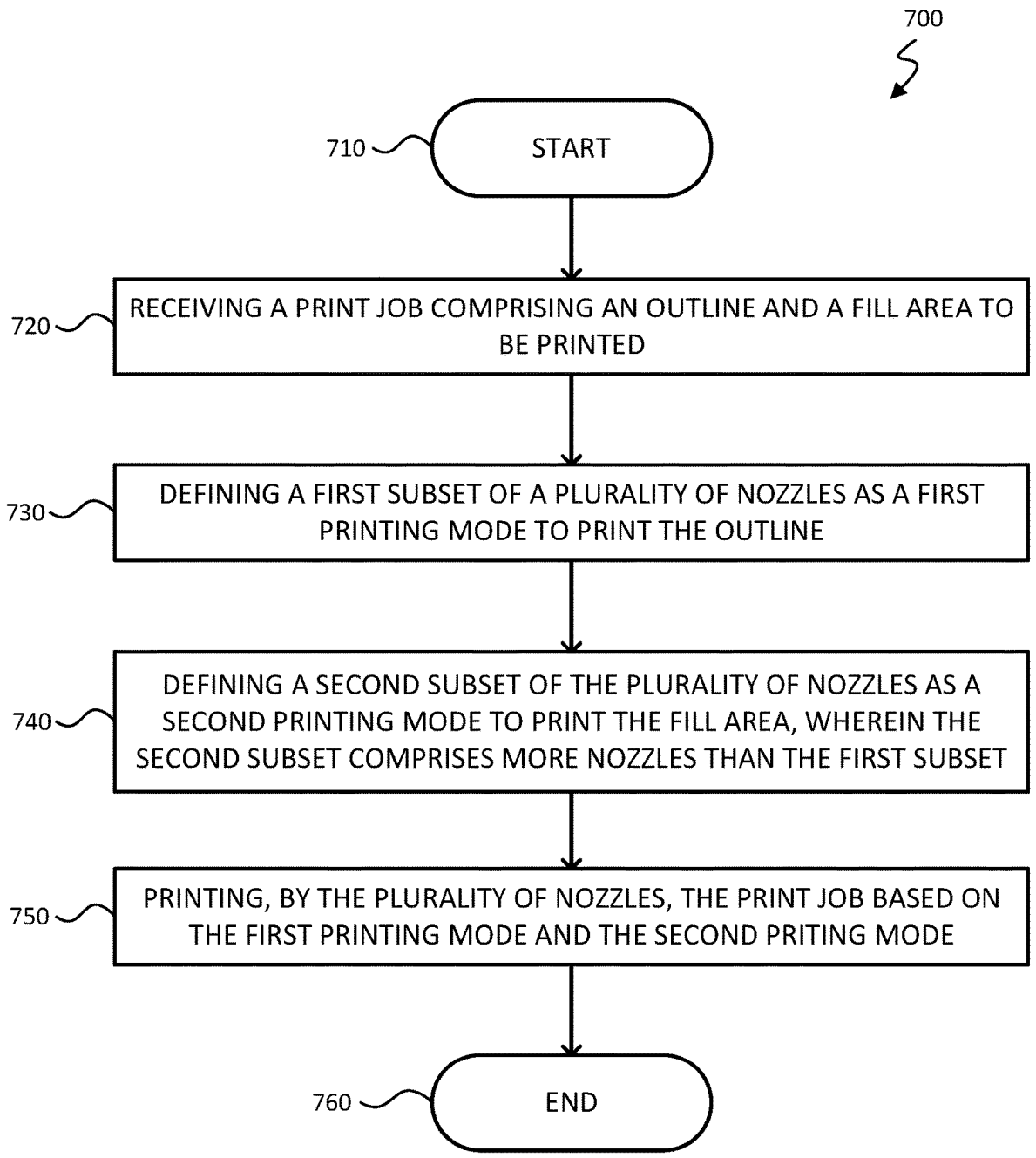
FIG. 7 is a flowchart of an example method for printing with printing modes to print an outline and a fill area.

FIG. 7 is a flowchart of an example method 700 for printing with printing modes to print an outline and a fill area. Method 700 may be described below as being executed or performed by a printing system, such as printing system 100 of FIG. 1. Various other suitable systems may be used as well, such as, for example printing system 200 of FIG. 2, printing system 300 of FIG. 3, printing system 400 from FIG. 4, and printing system 500 from FIG. 5. Method 700 may be implemented in the form of executable instructions stored on a machine-readable storage medium and executed by a single processor or a plurality of processors of the apparatus 100, and/or in the form of any electronic circuitry, for example digital and/or analog ASIC. In some implementations of the present disclosure, method 700 may include more or less blocks than are shown in FIG. 7. In some implementations, one or more of the blocks of method 700 may, at certain times, be ongoing and/or may repeat.

The method 700 may start at block 710, and continue to block 720, where a controller (e.g., controller 120 from FIG. 1) may receive a print job comprising an outline and a fill area to be printed. At block 730, the controller may define a first subset of a plurality of nozzles (e.g., plurality of nozzles 110 from FIG. 1) wherein such first subset is used to print in a first printing mode (e.g., first printing mode 112 from FIG. 1) to print the outline. At block 740, the controller may define a second subset of the plurality of nozzles (e.g., plurality of nozzles 110 from FIG. 1) wherein the second subset is used to print in a second printing mode (e.g., second printing mode 114 from FIG. 1) to print the fill area, wherein the second subset comprises more nozzles than the first subset. At block 750, the plurality of nozzles may print the print job based on the first printing mode and the second printing mode. At block 760, the method 700 may end. Method 700 may be repeated multiple times to print a print job.

Figure 8:
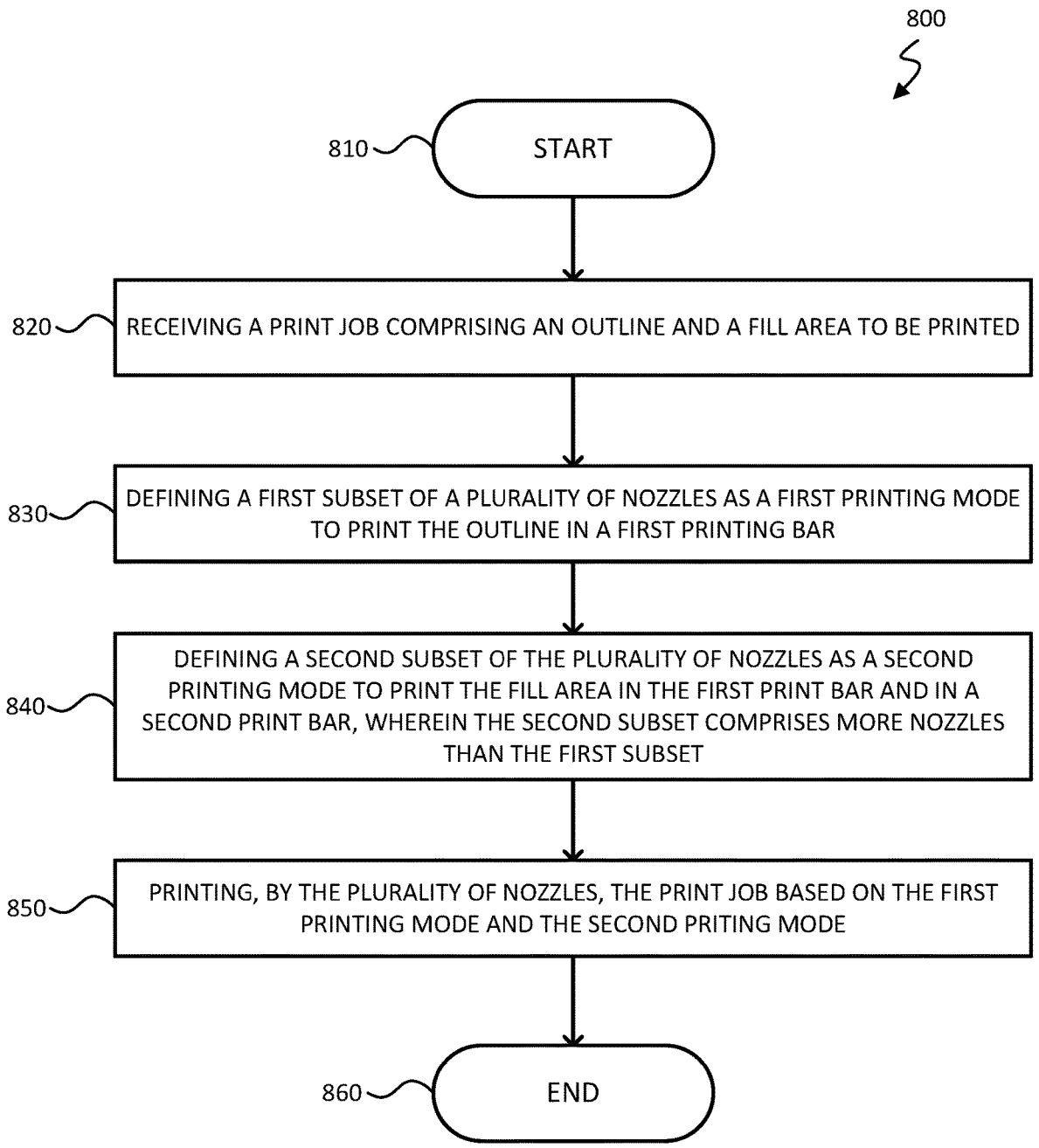
FIG. 8 is another flowchart of an example method for printing with printing modes to print an outline and a fill area.

FIG. 8 is another flowchart of an example method for printing with printing modes comprising an outline and a fill area. Method 800 may be described below as being executed or performed by a printing system, such as printing system 100 of FIG. 1. Various other suitable systems may be used as well, such as, for example printing system 200 of FIG. 2, printing system 300 of FIG. 3, printing system 400 from FIG. 4, and printing system 500 from FIG. 5. Method 800 may be implemented in the form of executable instructions stored on a machine-readable storage medium and executed by a single processor or a plurality of processors of the apparatus 100, and/or in the form of any electronic circuitry, for example digital and/or analog ASIC. In some implementations of the present disclosure, method 800 may include more or less blocks than are shown in FIG. 8. In some implementations, one or more of the blocks of method 800 may, at certain times, be ongoing and/or may repeat.

The method 800 may start at block 810, and continue to block 820, where a controller (e.g., controller 120 from FIG. 1) may receive a print job comprising an outline and a fill area to be printed. At block 830, the controller may define a first subset of a plurality of nozzles (e.g., plurality of nozzles 110 from FIG. 1) as a first printing mode (e.g., first printing mode 112 from FIG. 1) to print the outline in a first print bar (e.g., first print bar 210 from FIG. 2). At block 840, the controller may define a second subset of the plurality of nozzles (e.g., plurality of nozzles 110 from FIG. 1) as a second printing mode (e.g., second printing mode 114 from FIG. 1) to print the fill area in the first print bar and in a second print bar (e.g., second print bar 220 from FIG. 2), wherein the second subset comprises more nozzles than the first subset. At block 850, the plurality of nozzles may print the print job based on the first printing mode and the second printing mode. At block 860, the method 800 may end. Method 800 may be repeated multiple times to print a print job.

Furthermore, the methods 700, 800 may comprise a step of analyzing an image in order to extract from a print job the outline and the fill area prior to defining the subsets of nozzles to use in the first and the second printing modes.

Figure 9:
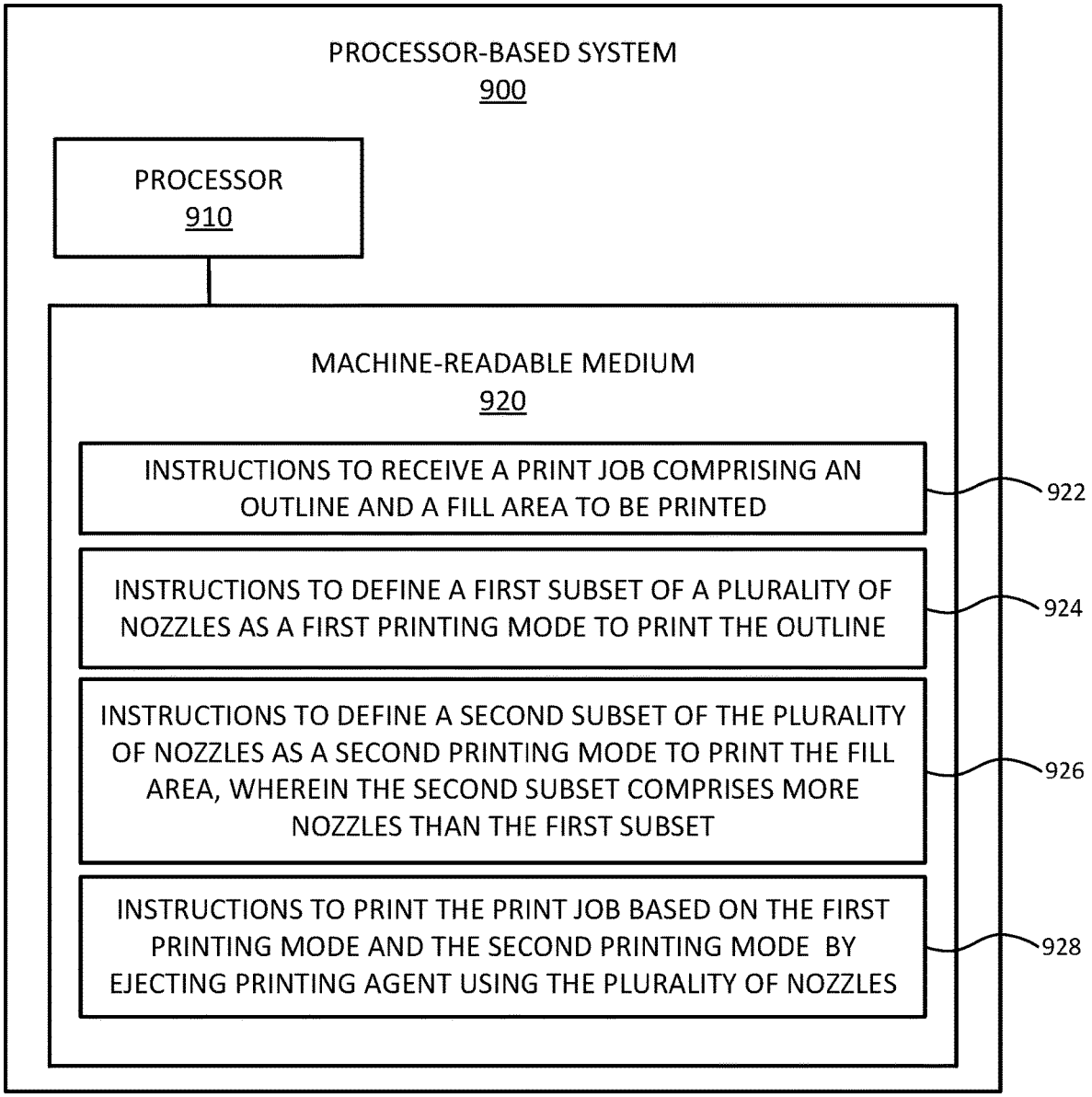
FIG. 9 is a block diagram illustrating an example of a processor-based system to print with printing modes to print an outline and a fill area.

FIG. 9 is a block diagram illustrating an example of a processor-based system 900 to print with printing modes to print an outline and a fill area. In some implementations, the system 900 may be or may form part of a printing device, such as an additive manufacturing system. In some implementations, the system 900 is a processor-based system and may include a processor 910 coupled to a machine-readable medium 920. The processor 910 may include a single-core processor, a multi-core processor, an application-specific integrated circuit (ASIC), a field programmable gate array (FPGA), and/or any other hardware device suitable for retrieval and/or execution of instructions from the machine-readable medium 920 (e.g., instructions 922, 924, 926, and 928) to perform functions related to various examples. Additionally, or alternatively, the processor 910 may include electronic circuitry for performing the functionality described herein, including the functionality of instructions 922, 924, 926, and/or 928. With respect of the executable instructions represented as boxes in FIG. 9, it should be understood that part or all of the executable instructions and/or electronic circuits included within one box may, in alternative implementations, be included in a different box shown in the figures or in a different box not shown.

The machine-readable medium 920 may be any medium suitable for storing executable instructions, such as a random-access memory (RAM), electrically erasable programmable read-only memory (EEPROM), flash memory, hard disk drives, optical disks, and the like. In some example implementations, the machine-readable medium 920 may be a tangible, non-transitory medium, where the term "non-transitory" does not encompass transitory propagating signals. The machine-readable medium 920 may be disposed within the processor-based system 900, as shown in FIG. 9, in which case the executable instructions may be deemed "installed" on the system 900. Alternatively, the machine-readable medium 920 may be a portable (e.g., external) storage medium, for example, that allows system 900 to remotely execute the instructions or download the instructions from the storage medium. In this case, the executable instructions may be part of an "installation package". As described further herein below, the machine-readable medium may be encoded with a set of executable instructions 922-928.

Instructions 922, when executed by the processor 910, may receive a print job comprising an outline and a fill area to be printed. Instructions 924, when executed by the processor 910, may define a first subset of a plurality of nozzles (e.g., plurality of nozzles 110 from FIG. 1) as a first printing mode (e.g., first printing mode 112 from FIG. 1) to print the outline. Instructions 926, when executed by the processor 910, may define a second subset of the plurality of nozzles (e.g., plurality of nozzles 110 from FIG. 1) as a second printing mode (e.g., second printing mode 114 from FIG. 1) to print the fill area, wherein the second subset comprises more nozzles than the first subset. Instructions 928, when executed by the processor 910, may print the print job based on the first printing mode and the second printing mode by ejecting printing agent using the plurality of nozzles.

The above examples may be implemented by hardware, or software in combination with hardware. For example, the various methods, processes and functional modules described herein may be implemented by a physical processor (the term processor is to be implemented broadly to include CPU, processing module, ASIC, logic module, or programmable gate array, etc.). The processes, methods and functional modules may all be performed by a single processor or split between several processors; reference in this disclosure or the claims to a "processor" should thus be interpreted to mean "at least one processor". The processes, method and functional modules are implemented as machine-readable instructions executable by at least one processor, hardware logic circuitry of the at least one processors, or a combination thereof.

The drawings in the examples of the present disclosure are some examples. It should be noted that some units and functions of the procedure are not necessarily essential for implementing the present disclosure. The units may be combined into one unit or further divided into multiple sub-units. What has been described and illustrated herein is an example of the disclosure along with some of its variations. The terms, descriptions and figures used herein are set forth by way of illustration. Many variations are possible within the scope of the disclosure, which is intended to be defined by the following claims and their equivalents.

What it is claimed is:

1. A printing system comprising:

a plurality of nozzles to eject a printing agent on a substrate to print a print job; and a controller programmed to:

receive the print job comprising an outline and a fill area to be printed, define a first subset of the plurality of nozzles as a first printing mode to print the outline, define a second subset of the plurality of nozzles as a second printing mode to print the fill area, wherein the second subset comprises more nozzles than the first subset, and operate the plurality of nozzles to print the print job, including operating the first subset of nozzles to print the outline based on the first printing mode and operating the second subset of nozzles to print the fill area within the outline based on the second printing mode.

2. The printing system of claim 1 wherein the first subset of the plurality of nozzles is a set of nozzles comprised in a first print bar, and the second subset of the plurality of nozzles is a set of nozzles comprised in the first print bar and a second print bar, wherein the second print bar is substantially parallel to the first print bar.

3. The printing system of claim 2 wherein the first print bar comprises a first printhead group comprising a plurality of printheads and the second print bar comprises a second printhead group comprising another plurality of printheads, wherein each printhead comprises a nozzle from the plurality of nozzles.

4. The printing system of claim 3 wherein the plurality of printheads in the first printhead group and the plurality of printheads in the second printhead group span a different area in a longitudinal bar axis.

5. The printing system of claim 2 comprising additional print bars with additional nozzles to eject the printing agent to the substrate, the additional print bars being part of the second printing mode, wherein the additional print bars are substantially parallel to the first print bar.

6. The printing system of claim 2 wherein the first print bar and the second print bar span substantially the full width of the substrate.

7. The printing system of claim 2 comprising a scanning mechanism to move the first print bar and the second print bar across a full width of the substrate, wherein the first print bar and second print bar span a section of the full width of the substrate.

8. The printing system of claim 2 wherein the first print bar is in closer to the substrate than the second print bar.

9. The printing system of claim 2 wherein the first print bar is placed upstream in the substrate advance direction with respect to the second print bar so that the first print bar ejects printing agent to the substrate before the second print bar.

10. The printing system of claim 1 wherein the outline is a line or set of lines enclosing a shape of a two-dimensional object.

11. The printing system of claim 1 wherein nozzles of the second subset eject drops of a larger size than nozzles of the first subset.

12. The printing system of claim 1 wherein the second subset does not comprise any nozzles from the first subset.

13. The printing system of claim 1 wherein the second subset comprises a nozzle or nozzles also in the first subset.

14. The printing system of claim 1 wherein the plurality of nozzles are grouped in a plurality of trenches, wherein each of the trenches is associated to a die, and wherein the dies are grouped in a printhead.

15. The printing system of claim 14 wherein the plurality of nozzles associated with a trench are to eject the same printing agent.

16. The printing system of claim 1 wherein the printing agent comprises a colorant included in the group comprising Cyan, Magenta, Yellow, and Black.

17. A method comprising:

receiving a print job comprising an outline and a fill area to be printed;

defining a first subset of a plurality of nozzles as a first printing mode to print the outline;

defining a second subset of the plurality of nozzles as a second printing mode to print the fill area, wherein the second subset comprises more nozzles than the first subset; and printing, by the plurality of nozzles, the print job based on the first printing mode and the second printing mode.

18. The method of claim 17, comprising:

defining the first subset of the plurality of nozzles in a first print bar; and defining the second subset of the plurality of nozzles in the first print bar and in a second print bar.

19. The method of claim 17 further comprising analyzing an image of the print job to extract from the image the outline and fill area.

20. A non-transitory machine readable medium storing instructions executable by a processor, the non-transitory machine-readable medium comprising:

instructions to receive a print job comprising an outline and a fill area to be printed;

instructions to define a first subset of a plurality of nozzles as a first printing mode to print the outline;

instructions to define a second subset of the plurality of nozzles as a second printing mode to print the fill area, wherein the second subset comprises more nozzles than the first subset; and instructions to print the print job based on the first printing mode and the second printing mode by ejecting printing agent using the plurality nozzles.

* * * * *